United States Patent [19]

Craft et al.

[11] 4,339,210

[45] Jul. 13, 1982

[54] RIBBON CARTRIDGE LOADING MECHANISM

[75] Inventors: James A. Craft; Selahattin A. Okcuoglu, both of Lexington, Ky.

[73] Assignee: International Business Machines Corporation, Armonk, N.Y.

[21] Appl. No.: 210,636

[22] Filed: Nov. 26, 1980

[51] Int. Cl.[3] ..... B41J 32/00

[52] U.S. Cl. ..... 400/208; 400/248

[58] Field of Search ..... 292/304, 302; 242/197, 242/198, 199, 200; 400/207, 208, 208.1, 248

[56] References Cited

U.S. PATENT DOCUMENTS

| | | | |
|---|---|---|---|
| 1,044,498 | 11/1912 | Comee | 292/304 |
| 3,207,453 | 9/1965 | Kilburg | 242/199 |
| 3,643,777 | 2/1972 | Anderson et al. | 400/248 |
| 3,643,779 | 2/1972 | Anderson et al. | 400/248 |
| 3,815,389 | 6/1974 | Richards, Sr. | 292/304 |
| 3,889,795 | 6/1975 | Garberi et al. | 400/208 |
| 3,990,563 | 11/1976 | Adanek et al. | 400/208 |
| 4,010,839 | 3/1977 | Guerrini et al. | 400/207 |
| 4,083,444 | 4/1978 | Salto | 400/208 |
| 4,239,107 | 12/1980 | Boyatt, Jr. et al. | 400/208.1 |
| 4,302,118 | 11/1981 | Schaefer | 400/208 |
| 4,310,257 | 1/1982 | Field et al. | 400/208 |

FOREIGN PATENT DOCUMENTS

| | | | |
|---|---|---|---|
| 55-114586 | 9/1980 | Japan | 400/248 |

*Primary Examiner*—William Pieprz
*Attorney, Agent, or Firm*—John A. Brady

[57] ABSTRACT

In a printing machine having a removable ribbon cartridge, means are provided for conveniently loading and unloading said ribbon cartridge on a support plate. Said means include guide means within the cartridge which cooperate with complementary guide means within the support plate for guiding the cartridge while it is being dropped-in onto the support plate; and lever operated cam/cam-follower means for then shifting the cartridge on the support plate to its final locked position. The cartridge unloading is performed through a reverse lever operation followed by a cartridge pick-up.

11 Claims, 5 Drawing Figures

RIBBON CARTRIDGE LOADING MECHANISM

FIELD OF THE INVENTION

This invention relates to an improved ribbon cartridge loading mechanism for use in an impact printing machine.

BACKGROUND OF THE INVENTION

In impact printing machines, a character printing operation is performed by transferring ink from an ink ribbon onto a record media, with said ink ribbon interposed between a typefont and said record media. Similarly, erase operation is also performed by interposing an erase tape or ribbon between typefont and record media and by striking the character to be erased on top of its own print.

Subsequent to each character printing or erasing operation, the involved tape has to be moved for bringing a new portion of the ribbon to face the print position on the machine. Generally speaking, a ribbon longitudinal motion, i.e., parallel to the record media, is provided by a ribbon feed mechanism transferring said ribbon from a supply location into a take-up and store location. Upon completion of said transfer to the take-up location, the ribbon is either transferred back to the supply location and used again in a similar manner or, in most cases, replaced by a new one. The ribbon replacement operation is usually a cumbersome and time consuming one for the operator.

A first improvement to the ribbon loading situation has been made by enclosing said ribbon into a cartridge to facilitate its handling by the operator. The ribbon cartridge includes either cavities or spools for supply and take-up storage.

For the improvement to be complete, the insertion of the ribbon cartridge and its proper adjustment into the printing machine should be as simple as possible. For that purpose, the printing machine has been provided with a substantially horiziontal support plate facing the platen holding the printing medium. In known machines, the ribbon cartridge is inserted at an angle relative to the support plate. The first inserted cartridge terminal being provided with a laterally extending axis of rotation is inserted into pivotal means provided on the complementary terminal end of the support plate. The cartridge is then downwardly rotated about said pivotal means and clamped into final position on the support plate.

Angular insertion is not as convenient to the operator as a simple dropping of the cartridge onto the support plate even through it might have advantages otherwise.

SUMMARY OF THE INVENTION

It is therefore an object of the invention to provide for a ribbon cartridge loading mechanism wherein said cartridge is being loaded vertically downwardly on a support plate and then laterally locked into final position.

Another object of the invention is to provide for a ribbon cartridge loading mechanism wherein said cartridge being dropped onto its support plate is then laterally shifted and locked into its final position through a simple lever actuation.

According to the present invention, a printing machine ribbon cartridge loading mechanism is provided wherein said cartridge is to be inserted on a substantially horizontal support plate and secured to said support plate into final position using a mechanism including guide means within said cartridge cooperating with complementary guide means within said support plate for guiding said cartridge during its vertical drop-in insertion onto said support plate; and lever operated, cam/cam-follower means on said cartridge and support plate for laterally shifting said cartridge on said support plate and bringing said cartridge into a final locked position.

A fuller understanding of the nature and advantages of the invention will derive from the following detailed description in conjunction with the accompanying drawing.

DETAILED DESCRIPTION OF THE INVENTION

Figure 1:
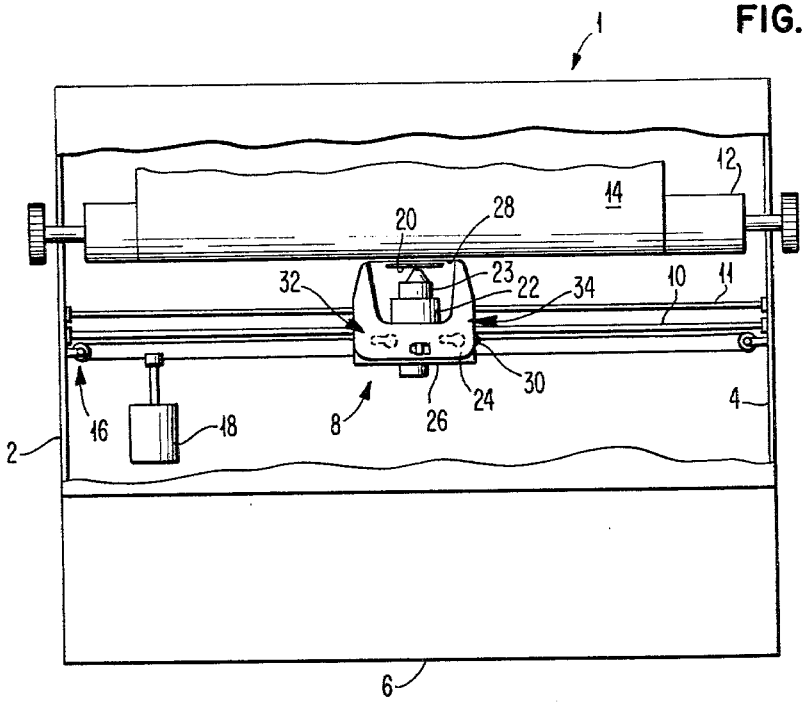
FIG. 1 shows a top plane view of a printing machine embodying the invention.

FIG. 1 shows a top plane view of a printing machine 1 embodying the invention. The printing machine 1 has left and right side plates 2 and 4 and a base 6, for housing the different operating parts of the printing machine 1.

A carriage assembly 8 is slidingly supported by guide rails 10 and 11 and is movable between said left and right side plates 2 and 4 in a direction which parallels a platen 12 used for holding a record media 14. The carriage assembly 8 motion is provided by a belt and pulley arrangement 16 driven by a stepper motor 18. The carriage assembly 8 carries a typefont, e.g., printwheel 20 driven by a character selection stepper motor 22, it also carries a print hammer mechanism 23 and a ribbon cartridge 24. The ribbon cartridge 24, securely sitting onto a substantially horizontal support plate 26, interposes a ribbon 27, e.g., inking ribbon (or erase ribbon) between the printwheel 20 and record medium 14.

In operation, printing is performed by driving the carriage assembly 8 along the platen 12 to a desired print position on the record medium 14 and then by actuating the printhammer mechanism 23 for striking a selected petal 29 (see FIG. 2) of said printwheel 20 against the record medium 14 and the inking ribbon 28. After each character printing operation, the inking ribbon 28 is moved by a spike driver 30 to bring a new portion of ribbon 28 in front of the position facing the print hammer mechanism 23. The portion of ribbon 28 between printwheel 20 and platen 12 may also be moved up or down a number of times to fully use the ribbon 28 width prior to moving said ribbon 28 longitudinally along the platen.

The longitudinal ribbon 28 shift which transfers the ribbon 28 from the cartridge supply location 32 onto the take-up location 34 is referred to as a driving or feeding operation. The ribbon 28 is in fact being driven to be fed into the take-up location 34 through use of the spike driver 30. The spike driver 30 is rotatably mounted on the support plate 26, with its spikes 35 (FIG. 2) engaging the ribbon when the cartridge 24 is loaded in its final position. A given angular rotation of the spike driver 30 is thus converted into a fixed increment linear displacement of the inking ribbon 28 which is being fed into the take-up location 34. Such a ribbon feed mechanism is disclosed in the U.S. Pat. No. 4,302,118, filed May 22, 1980, a division of an application filed May 27, 1977, entitled Typewriter Cartridge and Feed Mechanism Therefore, inventor, J. O. Schaefer, and U.S. Pat. No. 4,247,210, filed Oct. 30, 1979, entitled Ribbon Feed and Lift Mechanism For A Typewriter, inventors, D. J. Kacmarcik, S. A. Okcuoglu and J. W. Raider, and all assigned to the assignee of this application and herein incorporated by reference. These applications show the means for driving the spike driver 30 as well as the ribbon 28 lateral motion provided by the spike driver 30. After a number of longitudinal shifts, the ribbon 28 being thus transferred from the supply location 32 (e.g., spool) to the take-up location 34 (e.g., spool), the ribbon cartridge 24 has to be removed by the operator and replaced by a new one.

Figure 2:
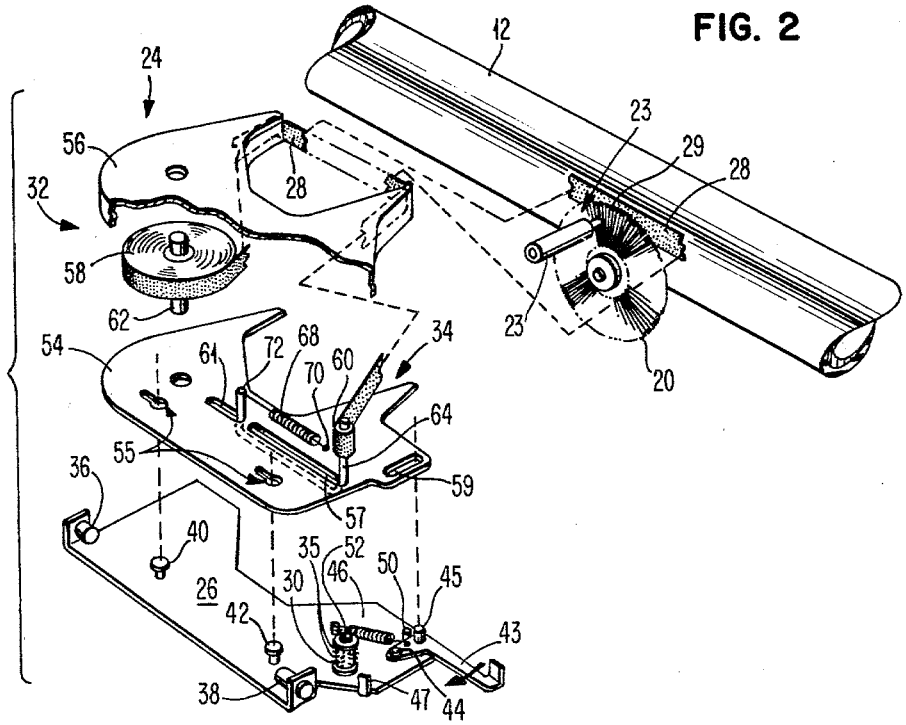
FIG. 2 shows an exploded representation of a preferred embodiment of the invention.

Referring to FIG. 2, an exploded view showing a first preferred embodiment of the invention is represented. The support plate 26 is provided with pivots 36 and 38 for being pivotally mounted on a carriage assembly 8 of FIG. 1 about a pivotal axis which parallels the platen 12. Two T-shaped guiding pins 40 and 42, to be used as complementary guide means for the cartridge 24 loading operation are mounted on the support plate 26. The spike driver 30 is rotatably mounted on the support plate 26 about a shaft 52 substantially perpendicular to said support plate 26. A lever 43 is also mounted on the support plate 26 for being pivotable in a plane substantially parallel to said support plate 26 about a pivot 44. The lever 43 is provided with a perpendicular camming pin 45. Two stop elements 47 and 50 are used to limit the rotation of the lever 43 between a "releasing" position (lever 43 being against stop element 50) and a "locking" position (lever 43 against stop element 47). A return spring 46 having one end attached to the support plate 26 and the other end attached to the lever 43 toggles the lever 43 in either of its extreme positions i.e., releasing position and locking position.

The ribbon cartridge 24 includes essentially, a base plate 54, a box shaped cover 56 attached to said base plate 54, a supply spool 58 and a take-up spool 60. The base plate 54 includes two guide means, i.e., key-holes 55 and three slots 57, 59 and 61. The supply spool 58 is rotatably mounted into the cartridge 24 about a shaft 62. The take-up spool is rotatably mounted on a U-shaped pivot 64, which pivot 64 is slidingly mounted by having its vertical branches inserted into the slots 57 and 61 provided into the base plate 54. A spring 68 grounded to the base plate 54 on one end 70 and attached to the U-shaped pivot 64 on the other end 72, tends to bring the take-up spool 60 to the right to keep said take-up spool 60 into contact with the spike driver 30 when the cartridge 24 is loaded in its final locked position on the support plate 26. Therefore, by rotating clockwise the spike driver 30 about its shaft 52 using a driver mechanism (not shown) the spike driver 30 is made to pull the ribbon 28 into the cartridge 24 and wrap said ribbon 28 about the take-up spool 60 which, while expanding, pushes to the left the U-shaped pivot 64 within the slots 57 and 61.

Figure 3:
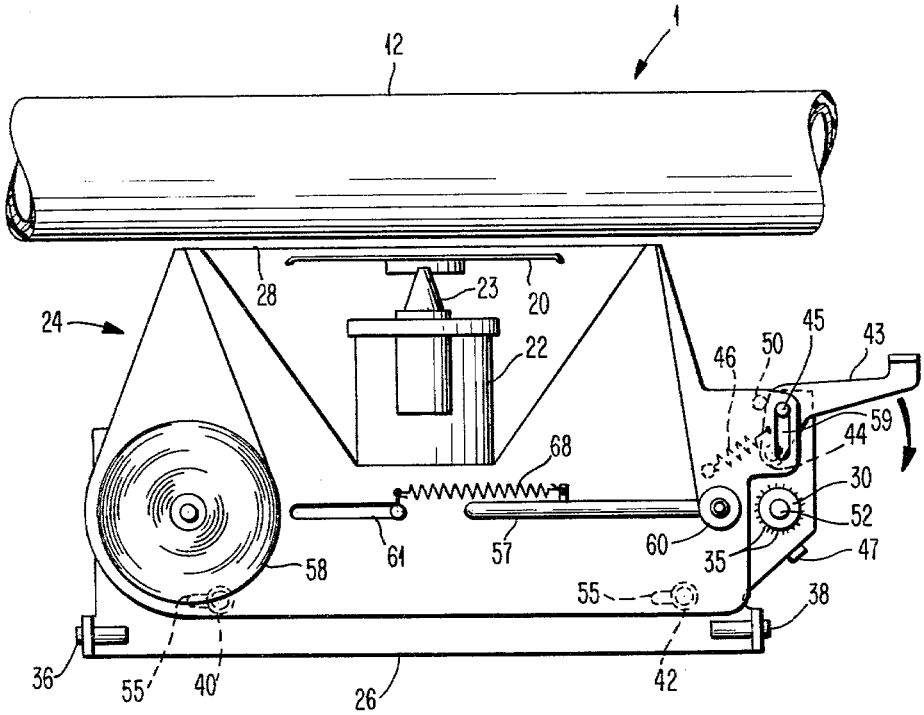
FIG. 3 shows a ribbon cartridge loaded in its unlocked position.

Referring now to FIG. 3, the ribbon cartridge 24 is shown loaded in its unlocked position. The cartridge 24 is loaded into the printing machine 1 by vertically dropping said cartridge 24 onto the support plate 26 in such a manner that the T-shaped guiding pins 40 and 42 acting as a first guide means be inserted into the widest portions of the corresponding key holes 55 acting as a second guide means. The pin 45 is also inserted into the slot 59 with the lever 43 being in its open or releasing position, i.e., against stop 50 of FIG. 2.

In order to fully load the cartridge 24, the lever 43 is rotated clockwise toward its locking position until it is stopped by stop element 47. The slot 59 acting as a cam-follower cooperates with the camming pin 45 being rotated clockwise about pivot 44 of FIG. 2, for laterally shifting to the right the cartridge 24 on the support plate 26 in a direction substantially parallel to the platen 12. The narrow portions of key-holes 55 cooperate with the T-shaped guiding pins 40 and 42 for guiding said cartridge 24 into its final position in which position the take-up spool 60 is brought into contact with the spike driver 30. The cartridge 24 is thus locked into final position on support plate 26, both vertically due to cooperation of the key-holes 55 with T-shaped pins 40 and 42, and laterally due to key-holes 55, pins 40, 42 and the toggle effect of lever 43.

The cartridge 24 is removable through a reverse operation. In other words the lever 43 is rotated counterclockwise against stop element 50 whereby the cam 45/cam-follower 59 operation shifts the cartridge 24 laterally to the left, aligning the pins 40 and 42 with the widest portions of key-holes 55, and disengaging the spike driver 30 from the take-up spool 60. The cartridge 24 is then vertically unlocked and ready to be picked up by the operator.

Figure 4:
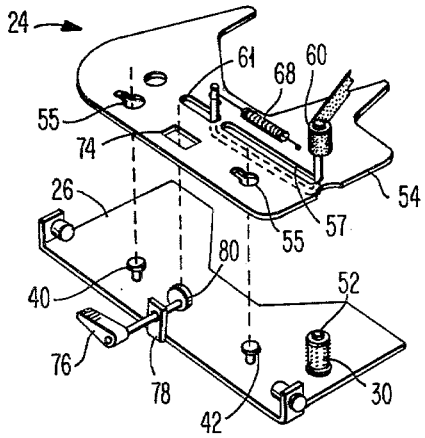
FIG. 4 shows an exploded view of a second embodiment of the invention.

Referring now to FIG. 4, a second embodiment of the invention is represented. The only significant difference between the devices shown in FIGS. 2 and 4, lies within the cam/cam-follower means used for laterally shifting the cartridge 24 sitting on its support plate 26. The cam-follower slot 59 of FIG. 2 has been replaced by another cam-follower slot 74 located between the key holes 55 of the base plate 54, while the camming lever 43 has been replaced by a lever 76. Said lever 76, rotates about an axis substantially perpendicular to the backside 78 of the support plate 26. The lever 76 drives an eccentric camming cylinder 80. With the lever 76 in its counterclockwise position as shown in FIG. 4. the system is ready for a cartridge 24 loading operation. The cartridge 24 may then be dropped-in vertically with the guiding means 55 cooperating as previously disclosed with complementary guide means 40 and 42. Also, the cylinder 80 is made to engage into slot 74. The lever 76 is then manually rotated by the operator in a clockwise direction thus shifting the cartridge 24 to the right, from its unlocked position to its locked position, through use of the cam/cam-follower operation provided by the lever 76 operated cylinder 80 engaged into slot 74.

Figure 5:
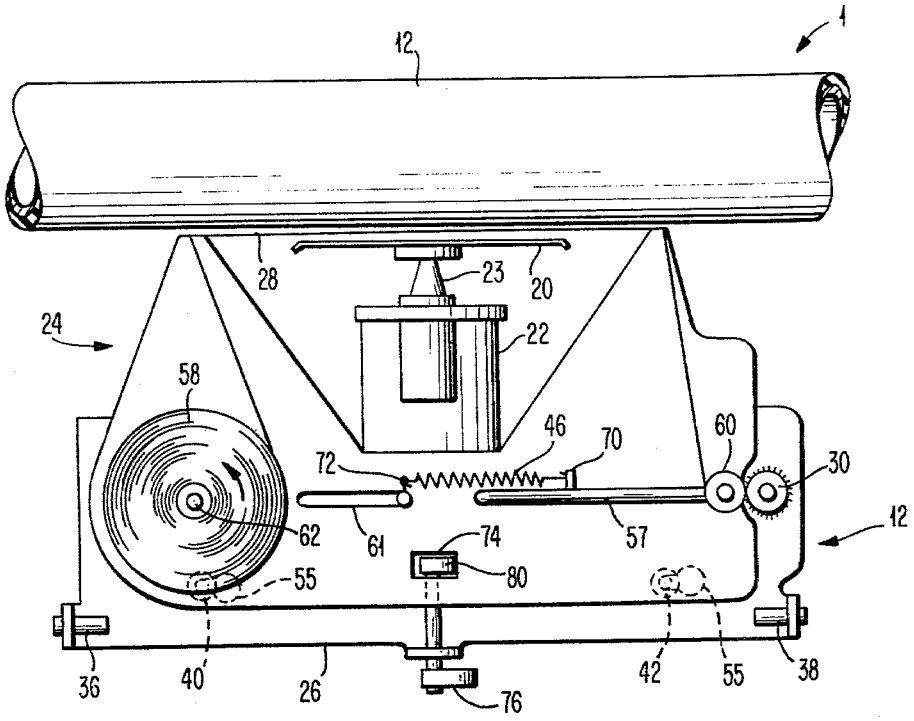
FIG. 5 shows a ribbon cartridge loaded into its final locked position using the mechanism of FIG. 4.

FIG. 5 shows the cartridge 24 into its final locked position with the lever 76 being into its final locking position and the spike driver 30 in a driving position.

While the invention has been particularly shown and described with reference to the preferred embodiments thereof, it will be understood by those skilled in the art that changes in form and details may be made therein without departing from the spirit and scope of the invention. For instance, the key holes 55 may be made into the base plates 54 while the guiding pins 40 and 42 would be made on the cartridge 24, and/or the number and positions of said pins 40 and 42 and key-holes 55 may be varied as suited.

Also, as mentioned in the above referenced co-pending applications herein incorporated by reference, it often happens that the printing machine 1 is provided with two different ribbons, one for printing purposes and one for erasing purposes. It must be understood that this invention applies to a cartridge including any one of these ribbons; it applies as well to a composite cartridge assembly as shown in the co-pending applications including both ribbons. In the latter case, the composite cartridge would be dropped-in for loading purposes onto the support plate 26 and would be removed from there as a simple ribbon cartridge 24 would. One may also provide the cam 80 with a recess or any other means cooperating with the cartridge base plate 54 to accentuate the cartridge locking effect in final position which locking is already provided by the friction between T-shaped pins 40 and 42 with the base plate 54 cooperating with the cam 8/cam-follower 74 in its locked position.

What is claimed is:

1. A ribbon cartridge loading mechanism wherein said cartridge is to be inserted on a support plate and secured to said support plate into a final position, said mechanism including:

a first guide means within said support plate cooperating with a second guide means within said cartridge, for guiding said cartridge during its drop-in insertion into said support plate to a unlocked position and vertically defining the position of said cartridge while permitting lateral shifting thereof;

cam-follower means on said cartridge and cam means on said support plate for laterally shifting said cartridge on said support plate to a position at which said cartridge is in a final locked position; and, a lever linked to said cam means manually positionable to a first position to position said cam means for said drop-in insertion and to a second position to move said cam means against said cam follower means to effect lateral shifting to said locked position.

2. A ribbon cartridge loading mechanism according to claim 1, wherein said final locking includes both vertical and lateral locking of said cartridge to said support plate.

3. In a printing machine according to claim 2 the ribbon cartridge loading mechanism wherein said cam/-cam-follower means are made of a camming pin substantially perpendicularly standing on said lever, said lever being pivotable in a plane which substantially parallels the support plate and capable of being toggled into locked and unlocked positions, with said camming pin made to engage a slot within the cartridge, wherein actuation of said lever results in a lateral shift of the cartridge about said support plate, which lateral shift switches the cartridge from an unlocked position to a locked position or vice-versa.

4. In a printing machine according to claim 2 the ribbon cartridge loading mechanism wherein said cam/-cam-follower means are made of said cam rotatable with said lever in a plane substantially perpendicular to said support plate for actuating an eccentric camming cylinder engageable into a camming slot within the cartridge, for laterally shifting said cartridge about the support plate to a locked position.

5. A ribbon cartridge loading mechanism for loading and securing a ribbon cartridge comprising a base plate and a cover onto a support plate, said mechanism including:

key-hole guide means within said base plate;

guiding pins located on said support plate for cooperation with said key-hole guide means while said cartridge is being dropped onto said support plate and vertically defining the position of said cartridge while permitting lateral shifting thereof;

cam means within said support plate cooperating with cam-follower means within said cartridge for laterally shifting said cartridge to a position wherein said cartridge is brought to a final locked situation; and, a lever linked to said cam means manually positionable to a first position to position said cam means for being dropped onto said support plate and to a second position to move said cam means against said cam-follower means to effect lateral shifting to said locked situation.

6. In a printing machine having a platen, a carriage assembly slidingly supported for being moved along said platen, said carriage assembly carrying a typefont, a replaceable ribbon cartridge for interposing a renewable portion of ribbon between typefont and platen and driver means engageable with said ribbon for laterally shifting the ribbon along the platen and transferring said ribbon from a supply location into a take-up location, a ribbon cartridge loading system including:

a support plate located within said carriage assembly;

first guiding means within said support plate;

second guiding means within said cartridge for cooperating with said first guiding means and guiding said cartridge during its drop-in insertion into the printing machine and vertically defining the position of said cartridge while permitting lateral shifting thereof;

cam means within said support plates;

cam-follower means within said cartridge for subsequently laterally shifting said cartridge into a final locked position wherein said cartridge is secured to said support plate and said ribbon is brought into contact with said driver means; and, a lever linked to said cam means manually positionable to a first position to position said cam means for said drop-in insertion and to a second position to move said cam means against said cam-follower means to effect lateral shifting to said locked position.

7. In a printing machine according to claim 6, the ribbon cartridge loading mechanism wherein said guiding means include T-shaped pins within said support plate cooperating with key-holes shaped into said cartridge for vertically locking the cartridge onto the support plate.

8. In a printing machine according to claim 7 the ribbon cartridge loading mechanism wherein said cam/-cam-follower means are made of a camming pin substantially perpendicularly standing on said lever, said lever being pivotable in a plane which substantially parallels the support plate and capable of being toggled into locked and unlocked positions, with said camming pin made to engage a slot within the cartridge, wherein actuation of said lever results in a lateral shift of the cartridge about said support plate, which lateral shift switches the cartridge from an unlocked position to a locked position or vice-versa.

9. In a printing machine according to claim 7 the ribbon cartridge loading mechanism wherein said cam/-cam-follower means are made of said cam rotatable with said lever in a plane substantially perpendicular to said support plate for actuating an eccentric camming cylinder engageable into a camming slot within the cartridge, for laterally shifting said cartridge about the support plate to a locked position.

10. In a printing machine having a platen, a carriage assembly slidingly supported for being movable along said platen, said carriage assembly carrying a typefont and a support plate for supporting a replaceable ribbon cartridge for interposing during operation a removable portion of ribbon between typefont and platen, said support plate also carrying a spike driver rotatably mounted on said support plate for being rotatable about an axis substantially normal to said support plate, a ribbon cartridge loading mechanism including:

first guiding means within said support plate cooperating with second guiding means within said cartridge for guiding said cartridge during its drop-in insertion into the printing machine and vertically defining the position of said cartridge while permitting lateral shifting thereof;

camming means within said support plate cooperating with cam-follower means within said cartridge for subsequently shifting said cartridge into a final position wherein said cartridge is vertically and laterally locked to said support plate while it is also being brought into contact with said spike driver; and, a lever linked to said cam means manually positionable to a first position to position said cam means for said drop-in insertion and to a second position to move said cam means against said cam-follower means to effect lateral shifting to said locked position.

11. In a printing machine according to claim 10, a ribbon cartridge loading mechanism wherein said cartridge includes a take-up spool, which spool is spring biased within said cartridge to maintain said contact with said spike driver throughout the operation of said ribbon.

* * * * *